US005234320A

United States Patent [19]

Domenge

[11] Patent Number: 5,234,320

[45] Date of Patent: Aug. 10, 1993

[54] CENTRIFUGAL SUCTION PUMP

[76] Inventor: Alberto G. Domenge, Fuente de las Aguilas 194, Tecamachalco 53950 Edo. de, Mexico

[21] Appl. No.: 882,975

[22] Filed: May 14, 1992

[51] Int. Cl.[5] ..... F04D 9/00; F04D 29/18

[52] U.S. Cl. ..... 417/40; 43/4.5; 43/6.5; 239/587.1; 415/25; 415/88

[58] Field of Search ..... 415/88, 25, 146, 203; 416/179; 43/4.5, 6.5; 239/282, 280, 280.5, 281, 265, 263.1, 587, 588; 417/40

[56] References Cited

U.S. PATENT DOCUMENTS

| | | | |
|---|---|---|---|
| 387,138 | 7/1888 | Bruce | 415/25 X |
| 473,037 | 4/1892 | Wainwright | 239/281 |
| 730,099 | 6/1903 | Dickie et al. | 415/88 X |
| 873,644 | 12/1907 | Wickblom | 415/25 |
| 882,524 | 3/1908 | Latta | 415/25 X |
| 967,122 | 8/1910 | Hall | 415/88 |
| 1,016,281 | 2/1912 | Lundquist | 239/280.5 |
| 1,577,225 | 3/1926 | Granger | 239/265 X |
| 2,319,229 | 5/1943 | Harrington | 417/40 |
| 3,519,365 | 7/1970 | Conhagen . | |
| 4,419,043 | 12/1983 | Smith . | |
| 5,042,187 | 8/1991 | Bentzley | 43/6.5 |

FOREIGN PATENT DOCUMENTS

| | | | |
|---|---|---|---|
| 291742 | 1/1971 | U.S.S.R. | 239/263.1 |
| 961497 | 6/1964 | United Kingdom | 417/40 |

*Primary Examiner*—Leonard E. Smith
*Attorney, Agent, or Firm*—Sandler Greenblum & Bernstein

[57] ABSTRACT

A centrifugal suction pump includes a vertically disposed support tube having upper and lower ends, a liquid check valve on the lower end of the support tube, and a hollow rotatable hub mounted on the upper end of the support tube. A number of horizontally expeller tubes are connected to the hub and extend radially therefrom. A check valve is associated with the hub for venting the hub to ambient atmosphere and a priming conduit is connected to the support tube for filing the latter and the expeller tubes with liquid. A stopper is associated with each expeller tube and has an operative position that seals the expeller tube. Rotation of the expeller tubes causes radial displacement of liquid therein which effects movement of the stoppers to an inoperative position at which the tubes are unsealed and liquid is pumped up the support tube.

20 Claims, 15 Drawing Sheets

CENTRIFUGAL SUCTION PUMP

TECHNICAL FIELD

This invention relates to centrifugal suction pumps.

BACKGROUND ART

Centrifugal suction pumps of the type having a vertically disposed support tube, a hollow hub rotatable mounted on the upper end of the support tube, and a plurality of horizontally exposed expeller tubes connected to the hub are known in the art. Centrifugal suction pumps of the type described utilize the centrifugal forces on liquid in the expired tubes as a consequence of rotation of the hub, for creating a suction in the support tube which draws liquid up the support tube and into the expression tubes thus achieving a pumping action.

U.S. Pat. No. 4419043 discloses a centrifugal suction pump of the type described, but the pump has a serious deficiency in that its priming is difficult, if not impossible, to accomplish. In other words, a centrifugal suction pump of the type described will operate properly only if the support and expeller tubes are filled with liquid. The '043 patent appears to be very difficult to prime. For this reason, proper operation of the pump is questionable.

U.S. Pat. No. 3519365 solves the priming problem by providing an external casing and immersing the expeller tubes in the liquid, but this creates a serious drag problem. Occasioned by rotation of the expeller tubes in the liquid. As a consequence, energy consumption for this pump is quite large. One disadvantage of centrifugal pumps utilizing an external casing is the difficulty and expensive in constructing expeller tubes which are long. This is a severe constraint that jeopardizes the efficiency of the pump and its capacity to pump large volumes of liquid.

It is therefore an object of the present invention to provide a new and improved centrifugal suction pump of the type described which substantially overcomes the problems encountered by prior art devices of the type described.

BRIEF DESCRIPTION OF THE INVENTION

The present invention provides a centrifugal suction pump for pumping a liquid comprising a vertically disposed support tube having upper and lower ends, a liquid check valve at the lower end of the support tube which is adapted to be immersed in a liquid to be pumped, and hollow hub rotatable mounted on an upper end of the support tube. The hub carries a member adapted to be driven for rotating the hub, and a plurality of horizontally disposed expeller tubes having inner and outer ends. The inner ends of each expeller tube is connected to the hub such that the expeller tubes extend radially from the hub.

A movable stopper is associated with each expeller tube, and is mounted on the outer end of the associated expeller tube. The stoppers have operative positions on the expeller tubes for sealing the tubes when the hub is stationary. They are movable to inoperative positions for unsealing the tubes in response to angular rotation of the hub. A check valve is associated with the hub for venting the interior of the hub to an ambient atmosphere. A priming conduit is connect to the support tube for filling the latter and said expeller tubes with liquid.

When the hub is stationary, and the stoppers are in their operative positions on the expeller tubes, the pump may be primed by using the priming conduit to fill the expeller tubes as well as the support tube with liquid to be pumped. The check valve in the hub serves to vent the hub thereby effecting a complete filling of the expeller tubes and the support tube with liquid. The stoppers serve to retain the liquid in the expeller tubes and the check valve at the lower end of the support tube serves to maintain the support tube and expeller tubes filled with liquid. The pump is thus primed and ready for operation.

When the member carried by the hub is driven, for example, by a motor, and the hub rotates, centrifugal force acting on the liquid in the expeller tubes will cause the liquid to move radially in the expeller tubes and move the stoppers form their operative position to their inoperative position. The inertial movement of the liquid in the expeller tubes draws liquid vertically up the support tube as the check valve is opened and additional liquid replaces the liquid that is expelled thereby achieving the desired pumping action. Although in some embodiments of the invention, an external casing is used, mainly for priming purposes, in all instances the expeller tubes move in ambient air when operational rotational speed is achieved.

BRIEF DESCRIPTION OF THE DRAWINGS

Embodiments of the present invention are shown by way of example in the accompanying drawings wherein.

DETAILED DESCRIPTION

Figure 1:
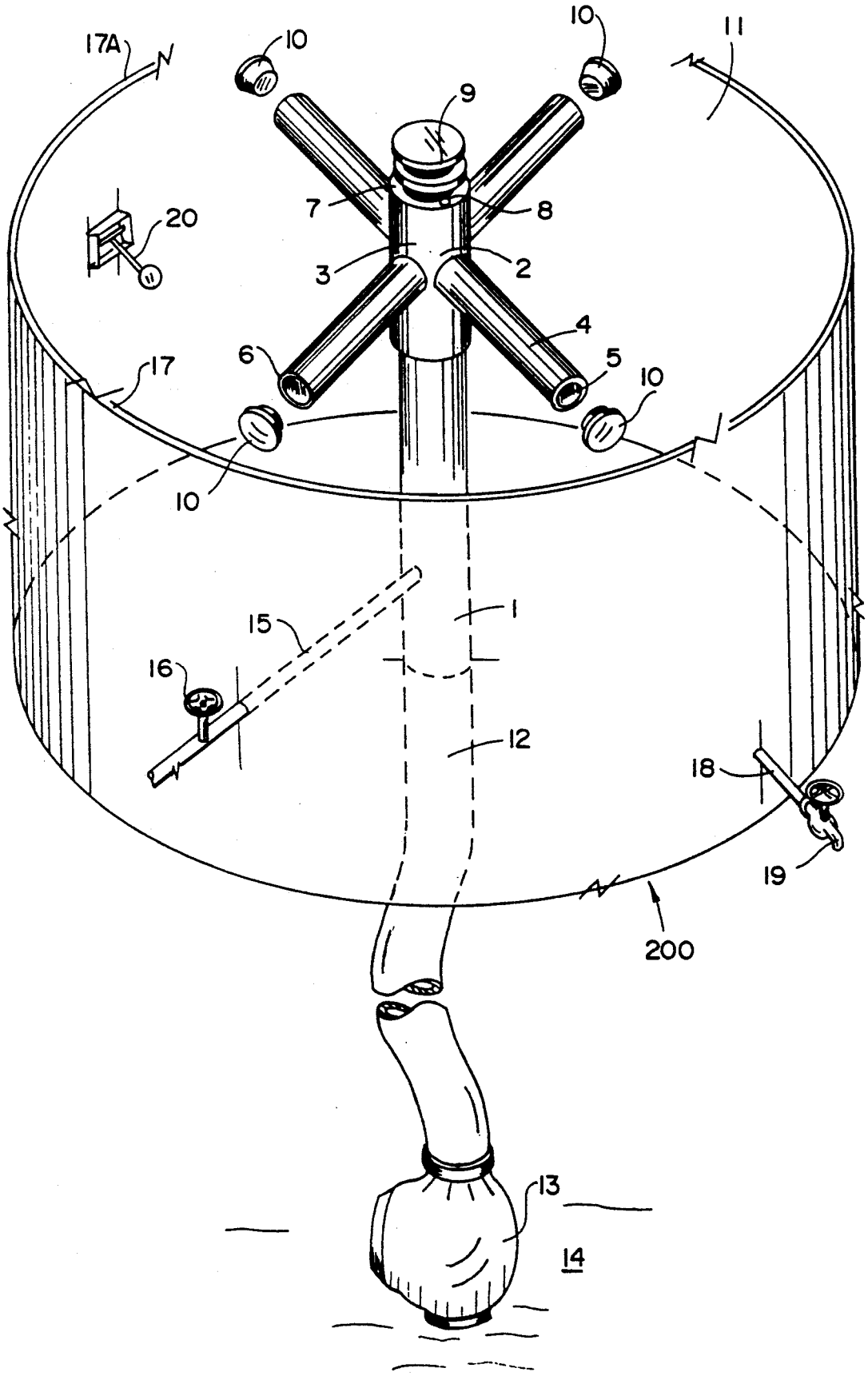
FIG. 1 is a perspective view of the first embodiment of a pump according to the present invention showing a vertically disposed support tube on which four radially extending expeller tubes are mounted.
Figure 2:
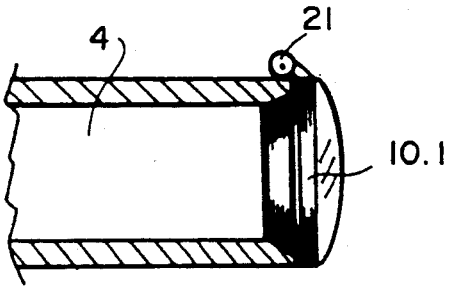
FIGS. 2 and 3 are top sectional views through the free end of an impeller tube showing a hinged stopper actuated by rotation of the expeller tubes.

Referring now to FIGS. 1–5 of the drawings, reference numeral 200 designates the first embodiment of a centrifugal suction pump according to the present invention for pumping liquid from source 14 to a higher level. The pump comprises vertically disposed support tube 1 having upper and lower ends, and duct 12 connected to the lower end. Liquid check valve 13 is attached to the lower end of duct 12, which may be totally or partially curvilinear, and is adapted to be immersed in a liquid to be pumped. Expeller head 2 is rotatable mounted on support tube 1 and includes hollow hub 3 rotatable mounted on the upper end of support tube 1. Hub 3 carries member 9 in the form of a pulley adapted to be driven by a motor (not shown) for rotating the hub. Expeller head 2 further includes a plurality of horizontally disposed expeller tubes 4 having inner and outer ends, the inner ends of each of the expeller tubes being connected to the hub such that the expeller tubes extend radially from the hub. While the drawing shows four expeller tubes, the invention is applicable to any number of expeller tubes.

Figure 3:
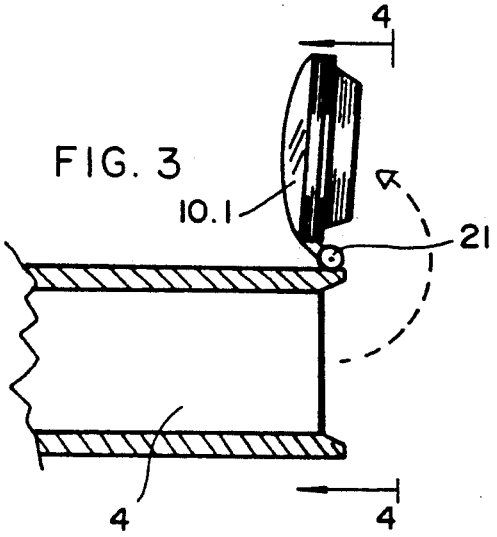
Figure 4:
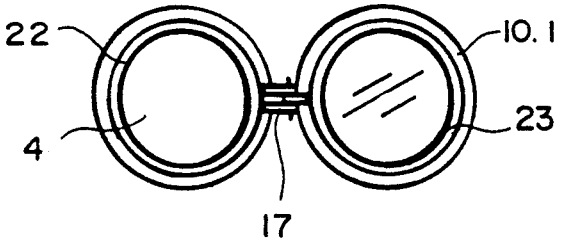
FIG. 4 is an end view taken along the line 4—4 of FIG. 3.
Figure 5:
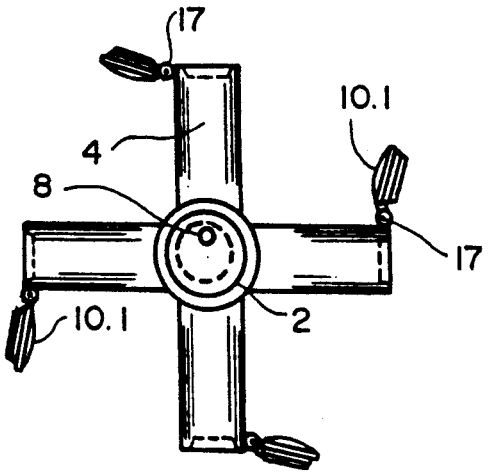
FIG. 5 is a plan view of a pump according to the present invention showing the stoppers in their inoperative position on the expeller tubes as a consequence of rotation of the expeller tubes.

A stopper 10 is associated with each expeller tube and includes hinges (shown in FIGS. 2–5) for mounting the stopper on the outer end of the associated expeller tube. Preferably, gasket 22 is provided on the peripheral edge of each expeller tube, and each stopper is provided with a similar gasket 23. Preferably, these gaskets are in the form of a magnetic foam that permits an essentially liquid tight seal to be formed when the stoppers are in their operative positions shown in FIG. 2. As a consequence of the hinged connections of the stoppers on the expeller tubes, centrifugal forces acting on the liquid in the tubes will thrust the liquid radially outwardly due to rotation of the expeller tubes about the axis of support tube 1 . This movement of the liquid will cause the stoppers to pivot from their operative positions to their inoperative positions as shown in FIG. 3 in response to rotation of the impeller tubes. When the hub suddenly and rapidly decelerates the initial response of the hinged stoppers causes them to pivot from their inoperative position to their operative position for sealing the respective expeller tubes. As a consequence of this arrangement, each stopper is responsive to angular rotation of the hub for sealing the expeller tube with which the stopper is associated when the hub decelerates to a stationary condition, and for unsealing the expeller tube with which the stopper is associated when the hub accelerates to a rotating condition.

Finally, priming conduit 15 is connected to support tube 1 to permit the latter to be filled with liquid by suitable operation of valve 16 in the conduit. By opening valve 16, liquid is supplied to vertical support tube 12 and also to expeller tubes 4, hub 8 being provided with air check valve 8 for the purpose of permitting air within the support tube and expeller tubes to be vented during priming.

In operation, the pump is primed when hub 2 is stationary by opening valve 16 and allowing liquid to completely fill vertical tube 12 and the various expeller tubes 4. While hub 2 is stationary, stoppers 10 are effective to seal the free ends of the expeller tubes thereby permitting the liquid from priming tube 15 to completely fill the pump. Any air trapped within the expeller tube or vertical tube is vented through check valve 8.

As hub 3 is rotated, for example by a motor (not shown), the centrifugal forces acting on the liquid in the expeller tubes causes this liquid to be displaced radially outwardly from the axis of rotation of the hub thereby moving the stopper to the position shown in FIG. 3 and allowing the liquid in the expeller tubes to be ejected. By reason of the flow of liquid from the expeller tubes, liquid from source 14 will be drawn into check valve 3 to replace the liquid that is being expelled from the expeller tubes. Thus, a pumping action is achieved by rotation of the hub.

Figure 6:
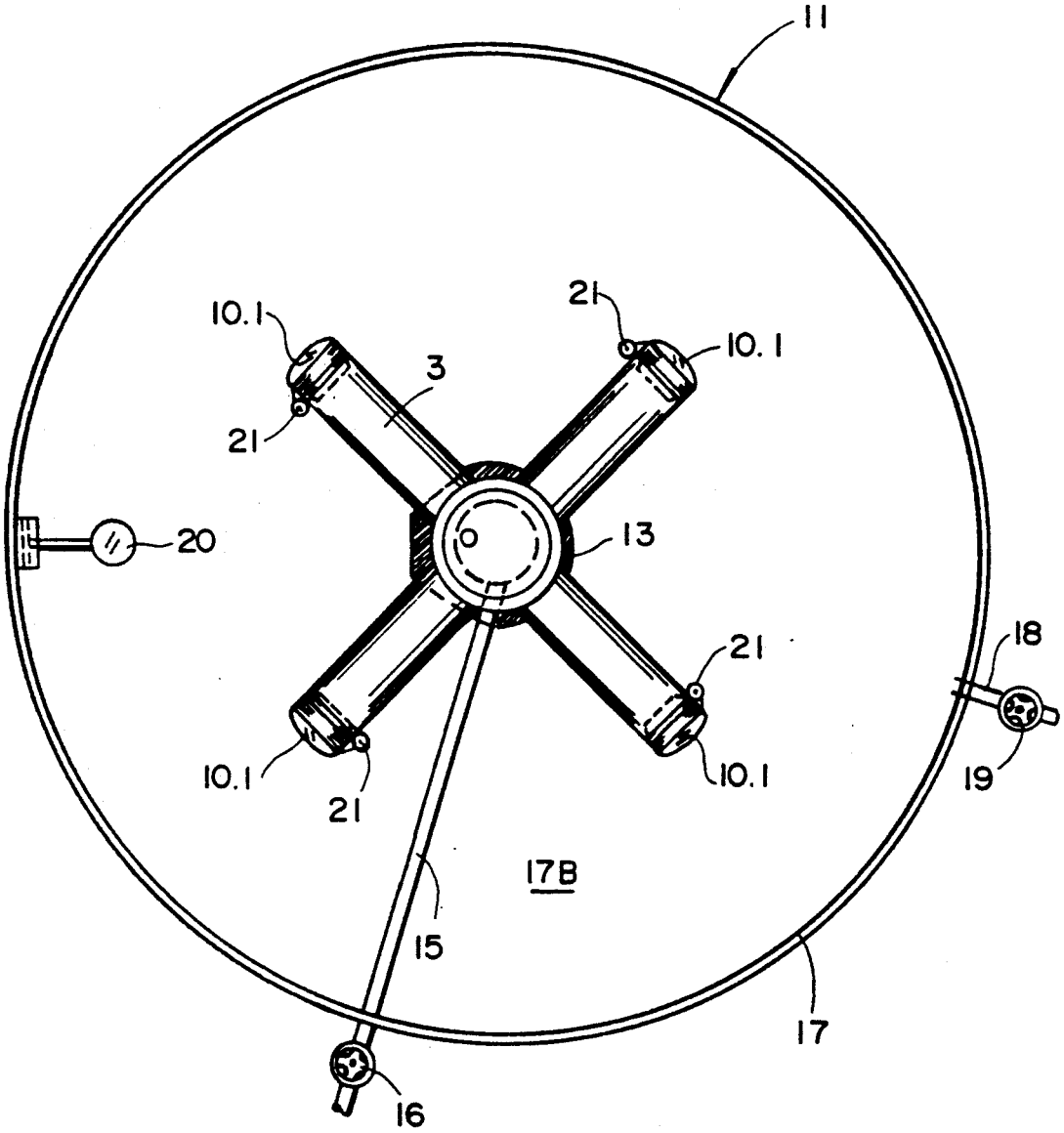
FIG. 6 is a plan view similar to FIG. 5 by showing the stoppers in the positioned occupied when the expeller arms are stationary.

As shown in FIGS. 1 and 6, expeller head 2 may be surrounded by a circular casing 11 having side walls 17 that terminate in upper free edge 17*a*, and bottom wall 17*b* through which support tube 1 passes. The connection between support tube 1 and bottom 17*b* is sealed to prevent the leakage of liquid from the casing. In such case, float valve 20 may be fixed to the inside of side wall 17 for the purpose of sensing the level of liquid within casing 11. The float valve, in a known manner, may be used to control the operation of drain valve 19 connected to output conduit 18 attached to side wall 17 of the casing. Alternatively, this float valve can be used for controlling the operation of the power source that rotatably drives hub 3.

Figure 7:
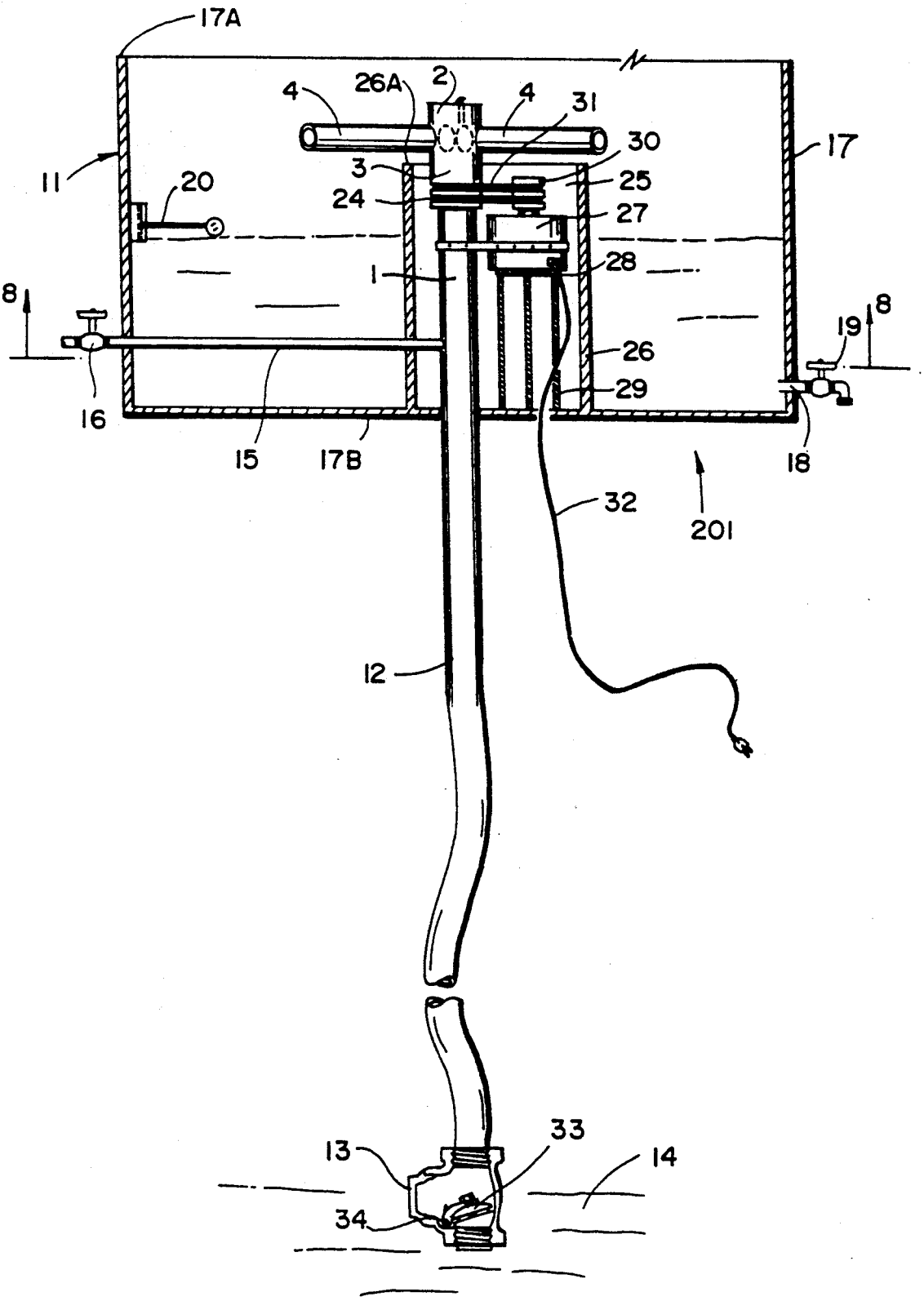
FIG. 7 is a vertical section of the second embodiment of the pump according to the present invention.
Figure 8:
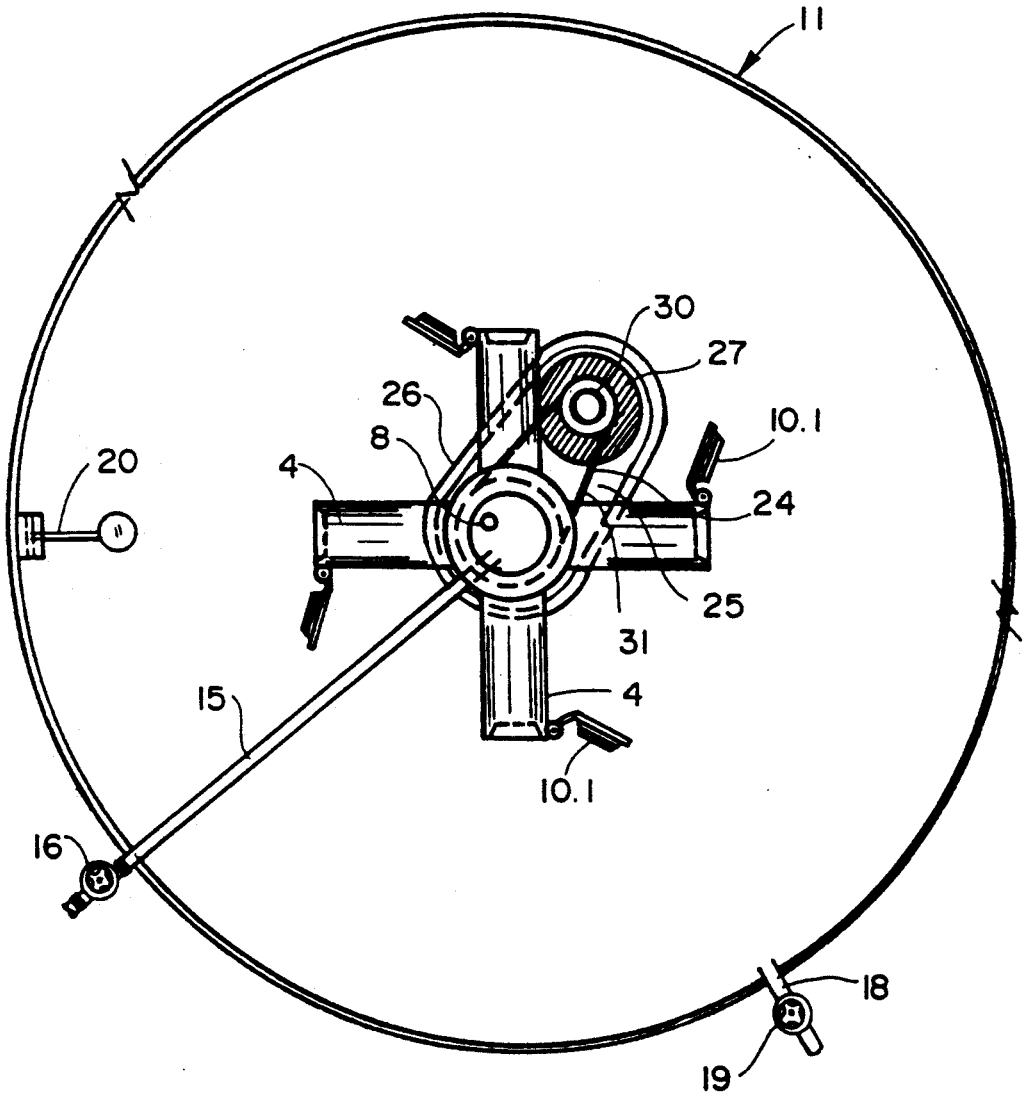
FIG. 8 is a view taken along the line 8—8 of FIG. 7.

Referring now to FIGS. 7 and 8, embodiment 201 of the centrifugal pump shown is similar to embodiment 200 except that in embodiment 201, liquid proof sleeve 26, which may be cylindrical, is provided; and no stoppers are shown. One end of the sleeve is attached to the bottom wall 17*b* concentric with the axis of support tube 12 such that sleeve 26 surrounds the support tube. Sleeve 26 has a top edge spaced from edge 17A of the casing such that the plane of rotation of expeller tubes 4 is intermediate to the top edges of the sleeve and casing as shown in FIG. 7.

Mounted within sleeve 26 is motor mount 28 to which motor 27 is attached. The output shaft of motor 27 is provided with pulley 30 which carries flexible belts 31 that mate with grooves 24 in hub 3 for the purpose of effecting rotation of the hub in response to operation of the motor.

Float 20 attached to side walls 17 can be utilized for the purpose of controlling the on-off operation of motor 27. That is to say, a switch controlling motor 27 could be opened when float 20 senses that the level in casing reaches the point just below the free end of sleeve 26. This would turn off the motor and prevent the pumping of the additional liquid from source 14 until the level of liquid in the casing drops to predetermined amount. The liquid contained in the casing is removed by operating valve 19.

Figure 9:
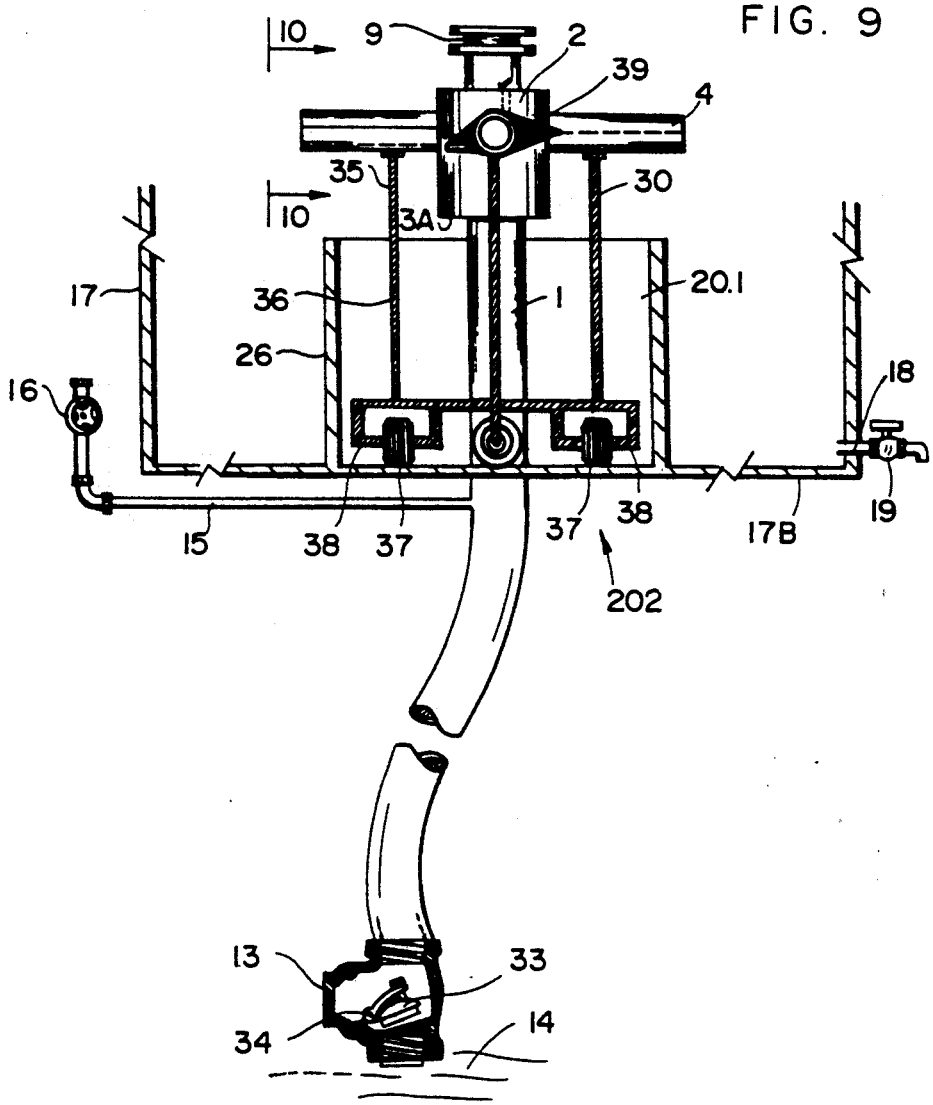
FIG. 9 is a vertical section of a third embodiment of a pump according to the present invention.

Embodiment 202 shown in FIG. 9 is similar to the embodiment 201 in that sleeve 26 is present. In this instance, however, carriage 36 is provided for supporting sleeve 3 on the axis of support tube 1. Specifically, carriage 36 comprises vertical arms 30 mounted on base 38 provided with a plurality of wheels 37 that rest on bottom 17*b* of the casing. In this embodiment, hub 3*a* is provided with an extension of the type shown in FIG. 1 for pulley 9. This pulley can be engaged by flexible belts attached to a motor for the purpose of imparting rotation to hub 3*a*.

Figure 10:
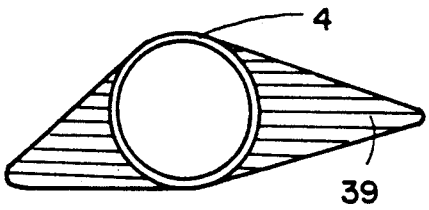
FIG. 10 is a cross section of the expeller tube shown in FIG. 9.
Figure 11:
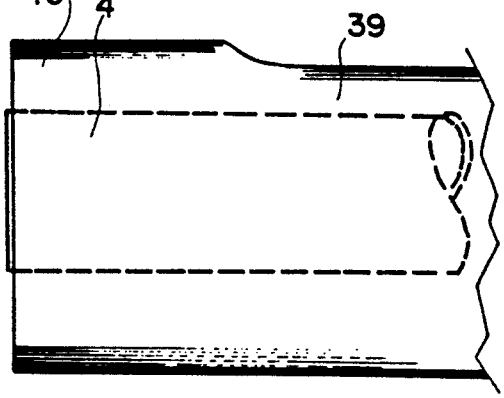
FIG. 11 is a modified version of the expeller tube shown in FIG. 9.

Because of the arrangement of the expeller tubes which are free of engagement with the liquid being pumped, aerodynamic drag of these tubes during rotation of hub 3*a* is reduced by aerodynamically shaping the expeller tubes. These shapes can be formed by aerodynamic sleeves 39 which fit over tubes 4. The cross-section of sleeve 39 is shown in detail in FIG. 10; and when used, these sleeves reduce the power required for driving the pump.

In order to further improve the aerodynamic characteristics of the expeller tubes during rotation, the aerodynamic sleeves may be provided with aileron-like fins 40 near the free ends of tube 4 for the purpose of providing lift in the form of an upwardly directed vertical thrust parallel to the axis of support tube 1.

Figure 12:
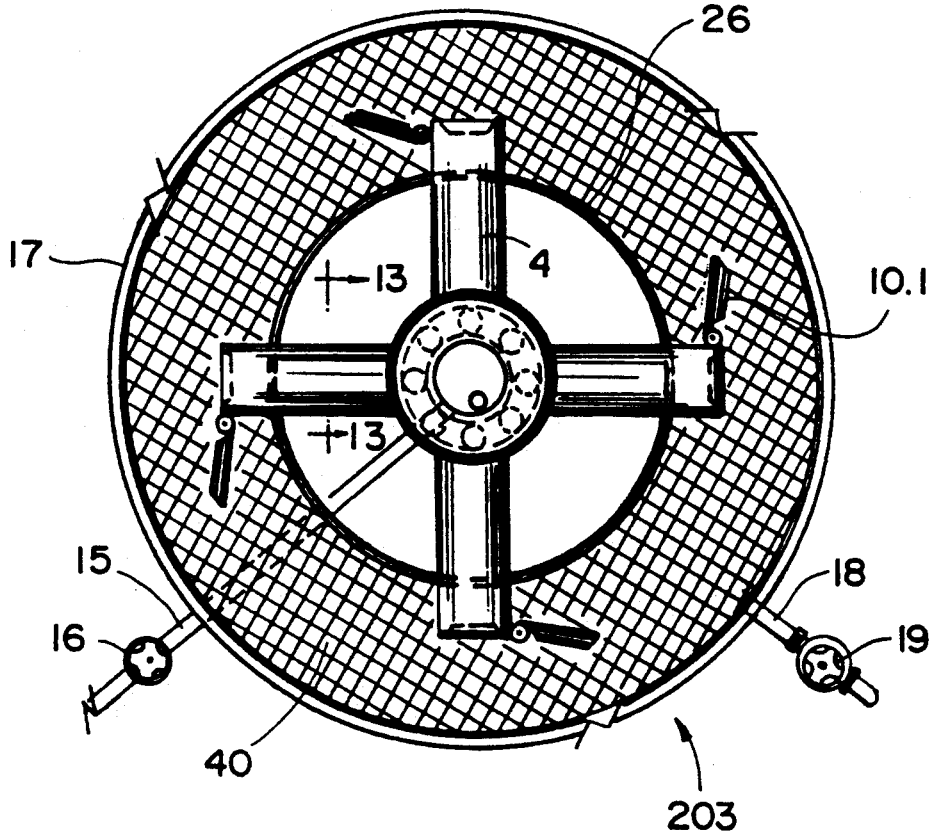
FIG. 12 is a plan view of a third embodiment of a pump according to the present invention.
Figure 13:
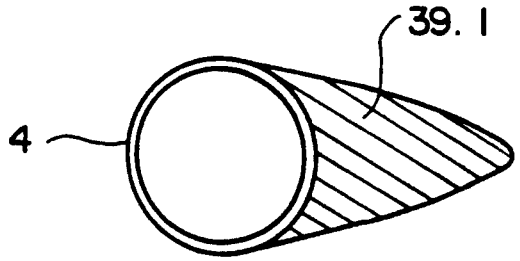
FIG. 13 is a sectional view taken along the line 13—13 of FIG. 12.

In embodiment 203 shown in FIGS. 12 and 13, aerodynamic sleeve 39.1 is provided. In addition, embodiment 203 utilizes mesh 40 which serves as an annular screen or filter for the liquid being pumped. The screen fits between the free edge 26A of sleeve 26 and side walls 17 of casing 11. In this manner, the liquid drawn through conduit 18 by reason of operation of valve 19 can be filtered.

Figure 14:
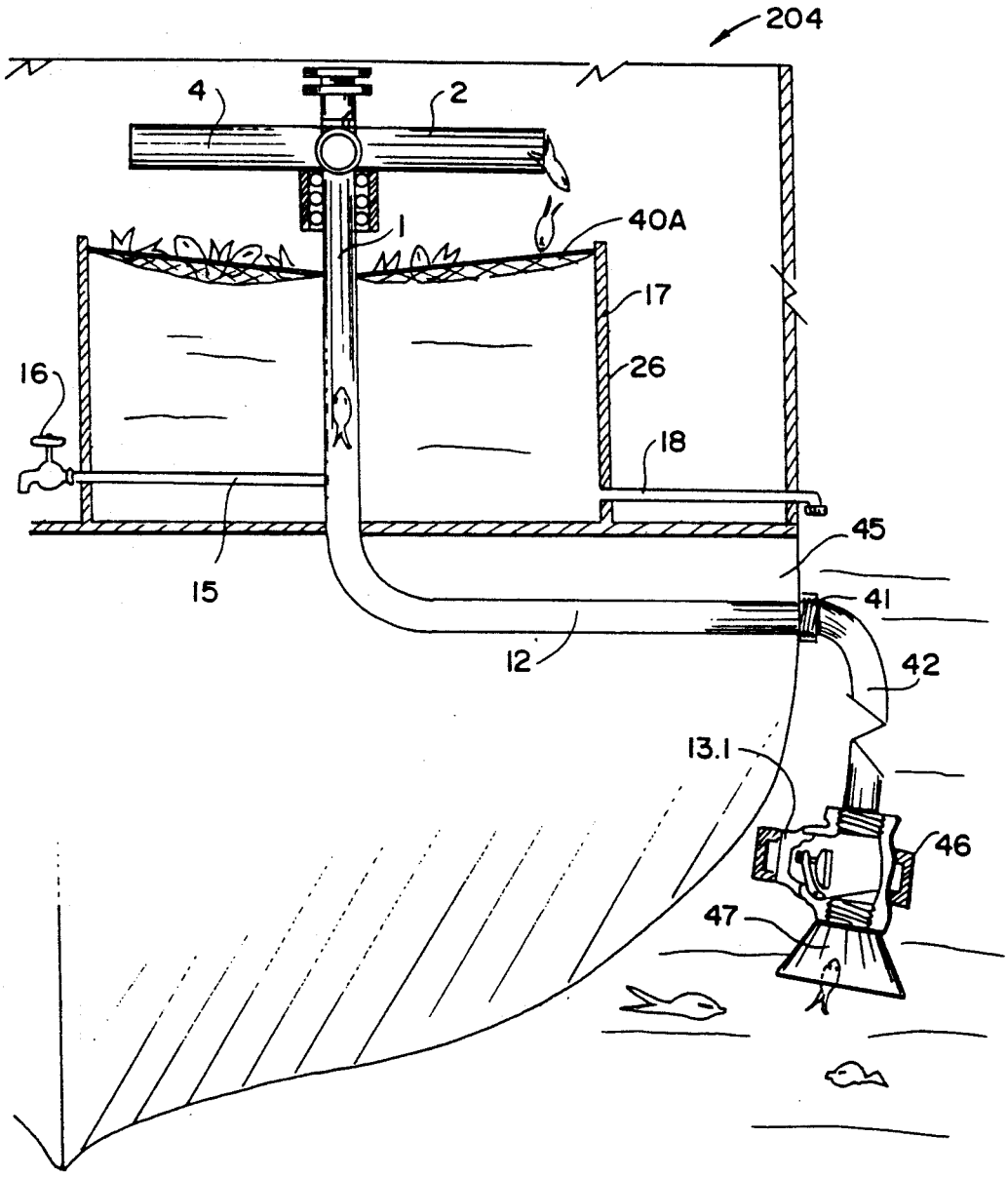
FIG. 14 is a vertical section of a fourth embodiment of the present invention.

Embodiment 204 shown in FIG. 14 can be utilized in a vessel or a boat wherein screen or mesh 40A is provided for the top of sleeve 26. As indicated, the centrifugal pump shown in this embodiment will draw aquatic life from the water in which boat 45 is traveling into the boat. The aquatic life is captured in the screen or filter 40A while the water is returned via conduit 18.

Figure 15:
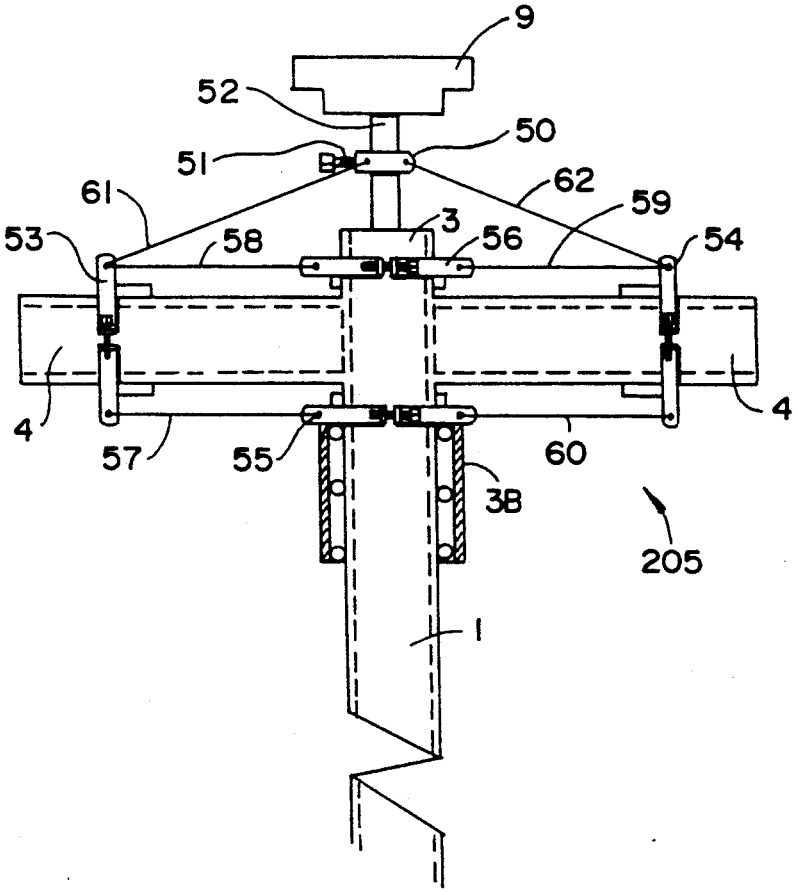
FIG. 15 is a side view of a support means for the expeller tubes applicable to the previously described embodiments.

In the embodiment shown in FIG. 15, support is provided for the radially extending expeller arms. This support device is particularly useful for expeller tubes which are very long. Longer expeller tubes are, within a range, a favorable tradeoff for angular speed of the expeller tubes. Specifically, support tube 1 is provided with rotatable hub 3*b* to which expeller tubes 4 are attached. Head 3*b* is provided with vertical extension 52 to which pulley 9 is attached. Clamp 51 is also attached to extension 52 for the purpose of providing supports for cables 61,62 which are attached to clamps 53 and 54 on respective expeller tubes 4. In addition, cables 57, 58, 59 and 60 are provided for the purpose of restraining clamps 53 and 54. These cables are connected to clamps surrounding hub 3*b*.

Figure 16:
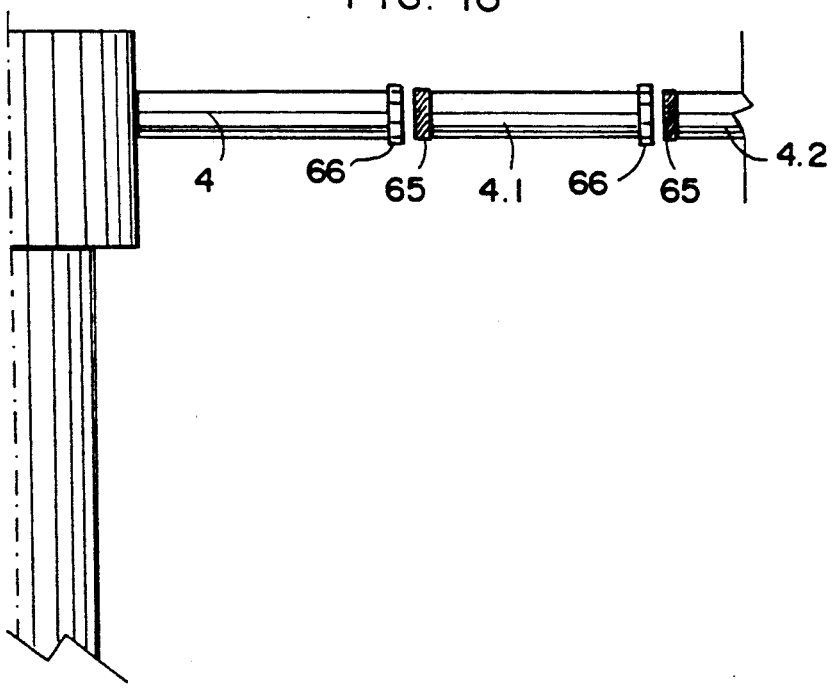
FIG. 16 is a side view of extensions for varying the length of the expeller tubes applicable to the previously described embodiments.

FIG. 16 shows an apparatus for changing the length of the expeller tubes. Specifically, the expeller tubes are made in sections 4, 4.1 and 4.2, for example. The axial ends of sections 4.1, 4.2, etc. are provided with male and female threads. Each section is provided with male thread 65 at one end and female thread 66 on the opposite end. In this manner, the sections may be attached to each other so that the length of the extension tubes can varied in accordance with the requirements.

Figure 17:
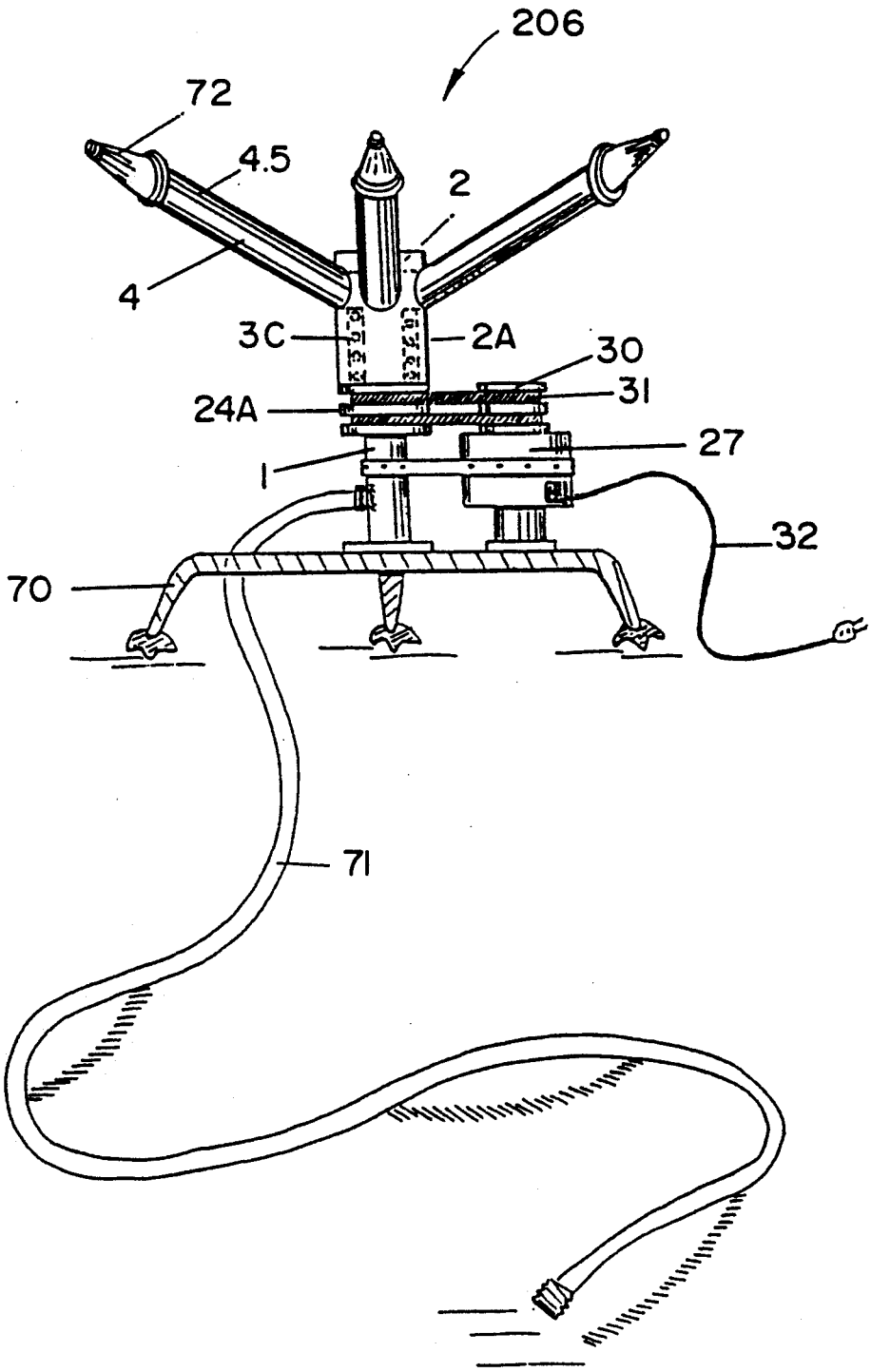
FIG. 17 is a side view of a further embodiment of the present invention.

Embodiment 206 shown in FIG. 17 is a sprinkler designed for sprinkling purposes. This embodiment includes base 70 carrying support tube 1 rigidly thereto. Expeller head 2*a* is, carrying pulley wheels 24A, is rotatable mounted on support tube 1. This expeller head is driven by belt 31 mating with pulley 30 attached to motor 27 attached to base 70.

The expeller head includes the plurality of expeller tubes 4 each carrying nozzle 72 its their free end. When power is applied to motor 27, the expeller head is rotated and spraying occurs by reason of water line 71 entering the support tube.

Figure 18:
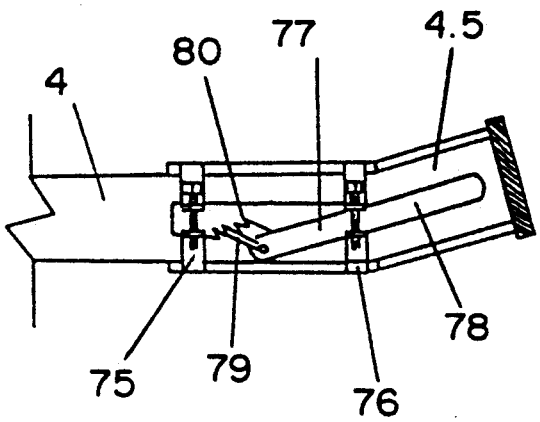
FIG. 18 is a side view, and section of means for changing the angle at which liquid is expelled from the expeller tubes, relative to the axis of rotation thereof.

In order to alter the angle at which liquid is directed from the axis of the support tube, the arrangement in FIG. 18 can be utilized. Specifically, expeller tube 4 is provided with clamps 75 and 76 which carry lever 78 rigidly attached to extension 4.5. Ratchet 79 engaged with ratchet teeth 80 carried by a bar connecting clamps 75 and 76 provide an operator with the ability to tilt end 4.5 at various angles with respect to the plane of rotation of expeller tube 4.

Figure 19:
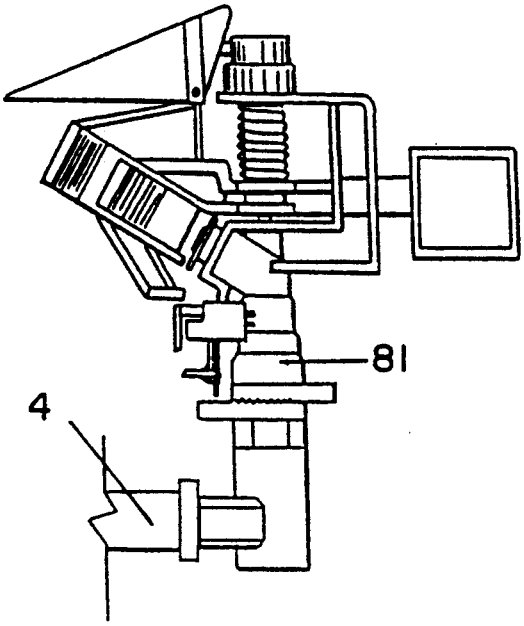
FIG. 19 is a side view of an expeller tube o the pump according to the present invention provided with a sprinkler.

FIG. 19 shows an arrangement in which conventional sprinkler head 81 is attached to an expeller tube.

Figure 20:
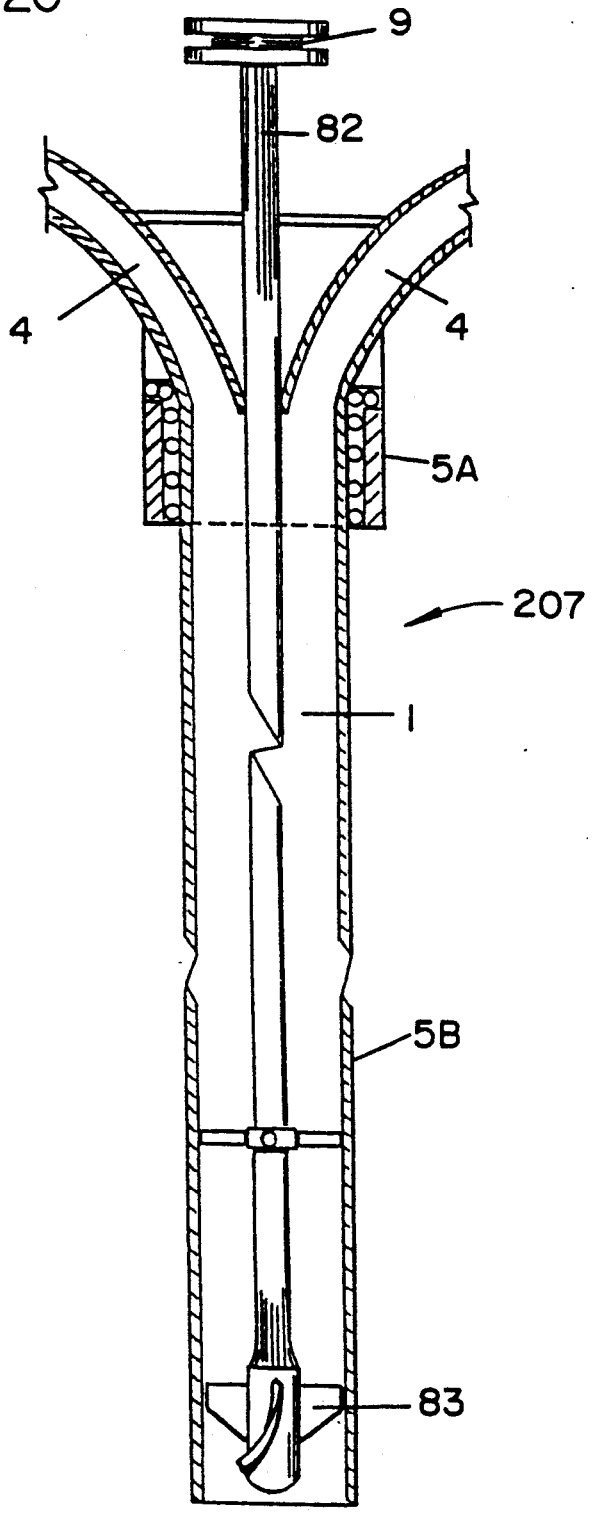
FIG. 20 is a further embodiment of the present invention.

Embodiment 207 as shown in FIG. 20 comprises shaft 82 having pulley 9 on one end and impeller turban 83 on the other end. Shaft 82 is rigidly mounted in sleeve 5B which extends into a liquid source, this tube being rotatably mounted in rigid support 5*a*. Rotation imparted to shaft 82 by a belt operatively engaged with pulley 9 serves to rotate sleeve 5B and impeller 83 relative to support 5*a* for the purpose of causing impeller 83 is force liquid upwardly through sleeve 5B and out expeller tubes 4 connected to sleeve 5B.

Figure 21:
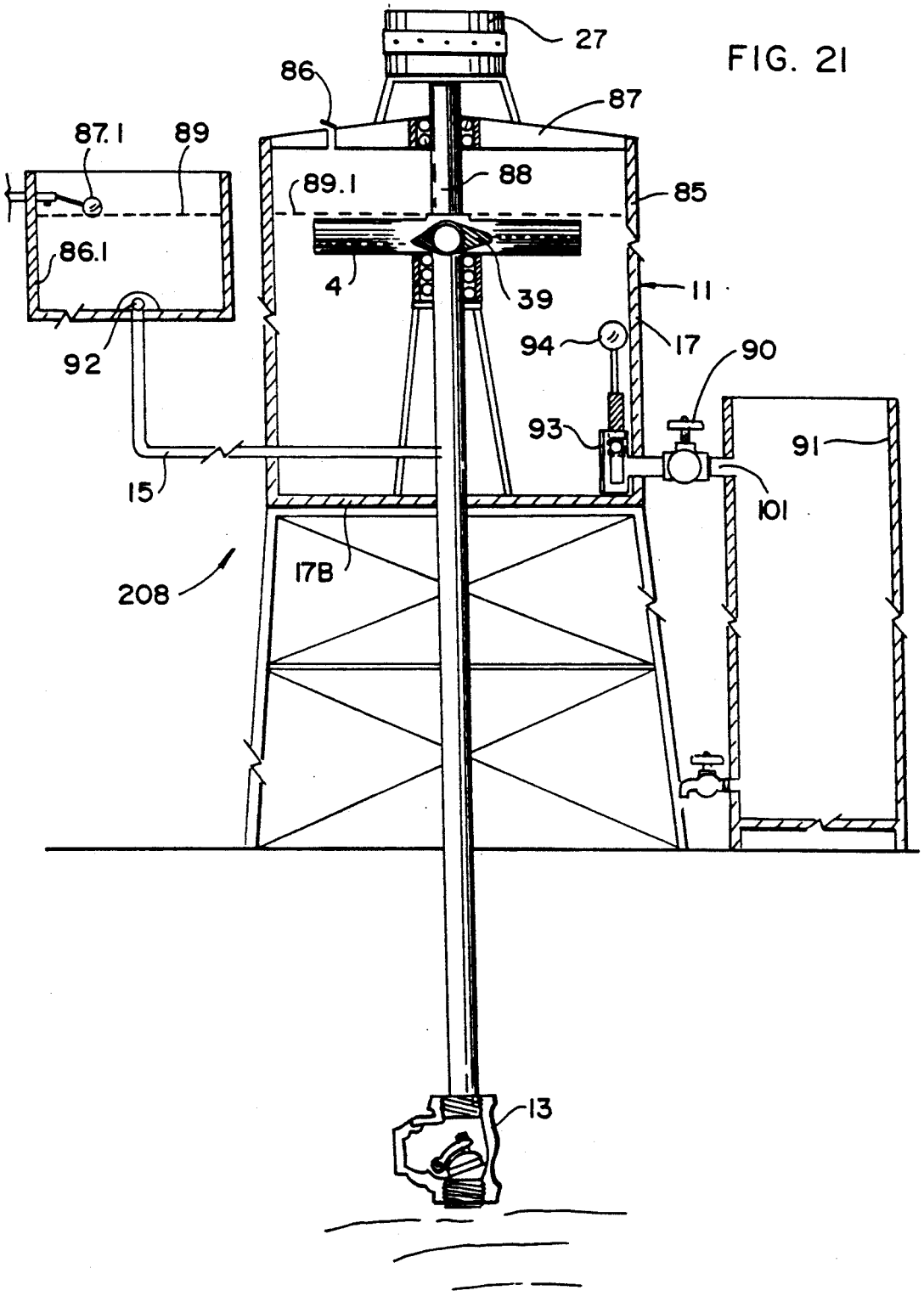
FIG. 21 is a vertical section view of a further embodiment of the present invention.

Embodiment 208 shown in FIG. 21 is an arrangement similar to the embodiment shown in FIG. 1, but utilizes external primer tank 86.1. In this embodiment, the centrifugal pump includes support shaft 88 which passes through bottom 17*b* of a casing surrounding the shaft, there being a seal between the support tube and the bottom. Motor 27 mounted on closure 87 which seals the casing, directly drives tube 88 to which expeller tubes 4 are attached. These tubes are provided with aerodynamic sleeves 39. Primer tank 86.1 is connected via conduit 15 to the support tube 88. When motor 27 is not operated and tube 88 is stationary, liquid in primer tank flows through conduit 15 into support tube 1 and into the expeller tubes 4. These tubes are not provided with stoppers. The height of primer 86.1 is such that level 89 of the liquid in the primer tank is above the expeller tubes such that liquid from the primer tank can completely fill the expeller tubes. Thus, when the expeller tubes are at rest, they are immersed in liquid whose level is indicated at 89.1 which initially and temporarily coincides with level 89.

In operation, the pump is primed as described previously, and motor 27 is turned on. After the expeller tubes have reached operational speed, valve 90 is manually opened, and level 89.1, inside the casing, drops below the the rotational plane of the expeller tubes causing a consequence vacuum (reduction in pressure) inside the casing which is airtight when valve 86 is closed. The flow of liquid in support tube 1 would tend to draw liquid from the primer tank but this is prevent by check valve 92. Air in the casing is vented via valve 86.

Figure 22:
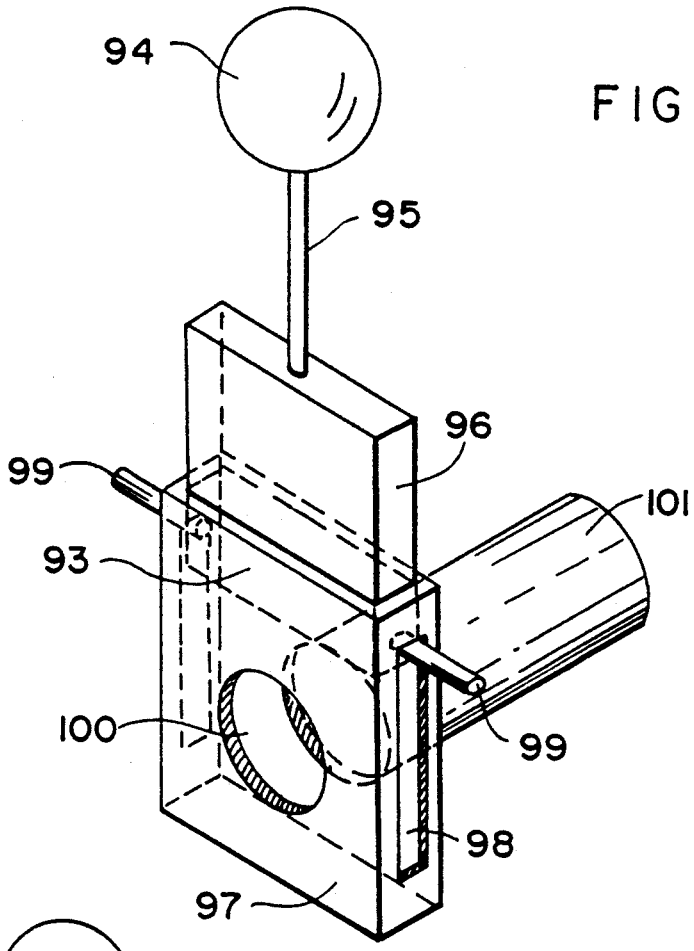
FIGS. 22–24 are views of a gate valve associated with the embodiment of the pump shown in FIG. 21.
Figure 23:
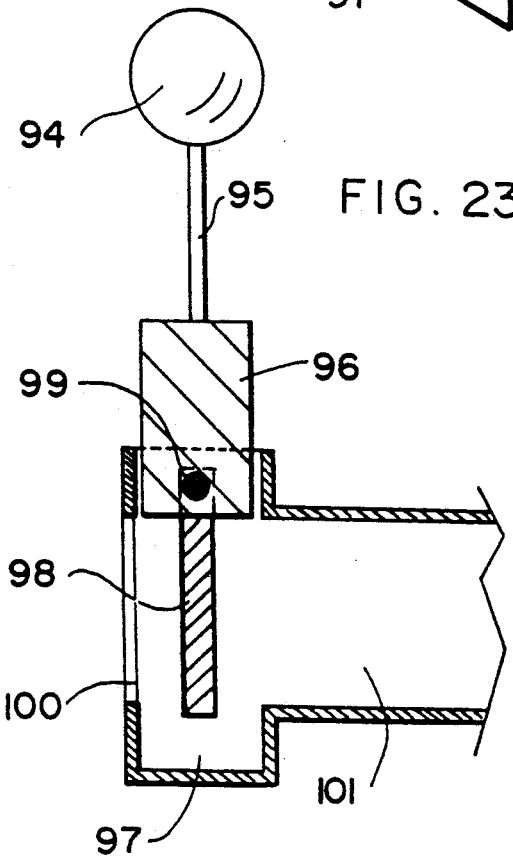
Figure 24:
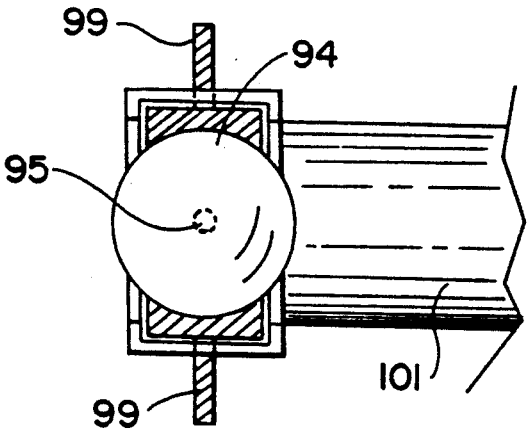

Float 94 in gate valve 93 serves to control the operation of this valve and the flow of water through conduit 101 into tank 91. The operation of this flow valve is illustrated in FIGS. 22–14 where the gate valve comprises float 94 connected by rod 95 to slider 96 which moves vertically in a matching opening in body 97 containing aligned apertures 100. Conduit 101 is connected to one of these openings and, slider 96 controls the flow of liquid into conduit 101 in accordance with the level of the slider occasioned by float 94. Slider 96 is guided by pins 99 which slide in slots 98 of body 97.

Figure 25:
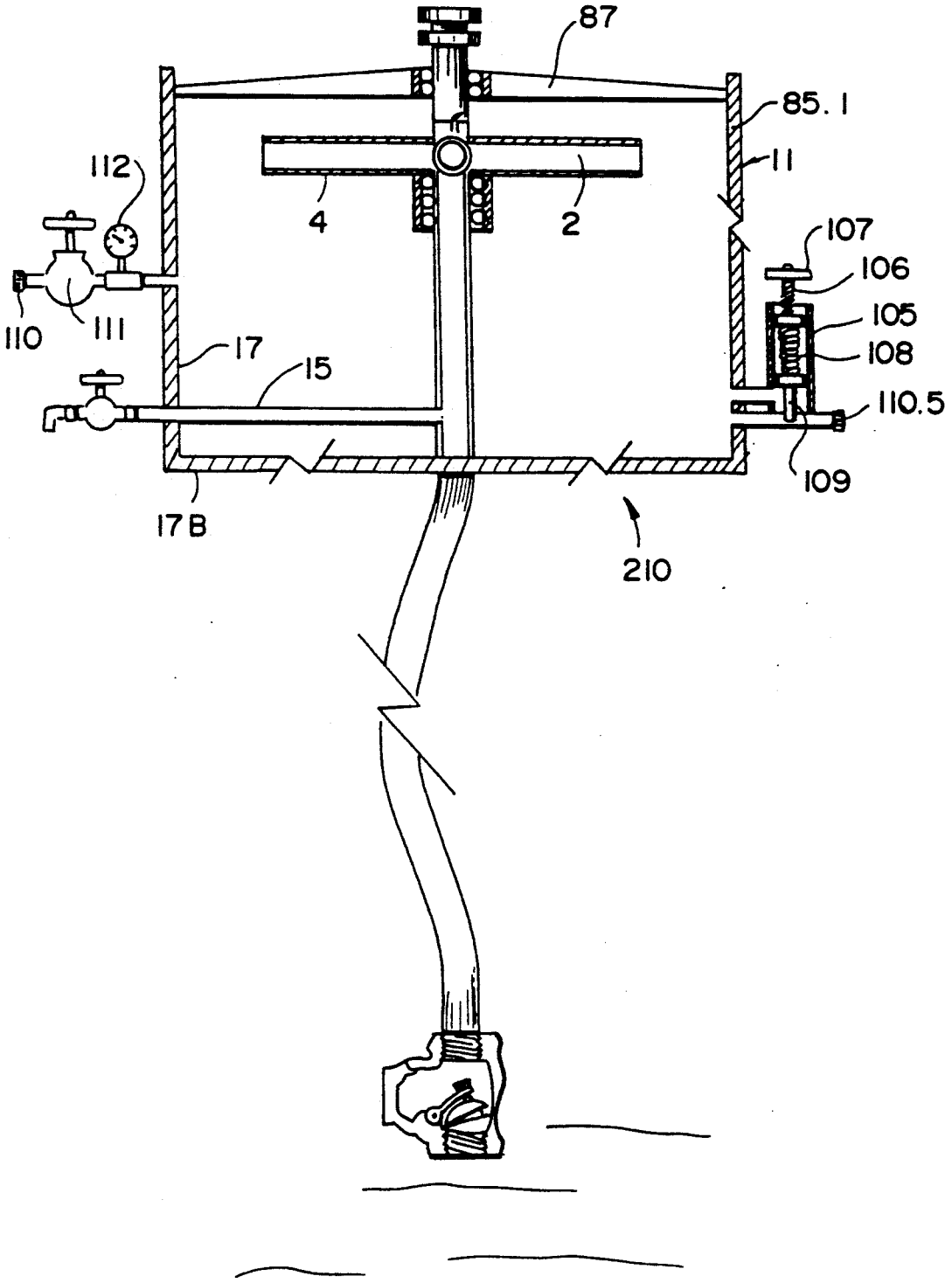
FIG. 25 is a vertical section of a further embodiment of a pump according to the present invention.

Embodiment 210 shown in FIG. 25 includes support tube 1 mounted in casing 11 having wall 17 and bottom **17*b*. Expeller head 2 is rotatable mounted on vertical tube 1 and cover 87 seals casing 85.1. This casing can be pressurized through valve 111 by supplying air to connection 110. Gauge 112 provides an indication of the pressure inside the casing. The pump is primed through conduit 15 by operation of valve 16**.

The air pressure in casing 85.1 maintains priming liquid inside radial expeller tubes 4 and in support tube 1. When the pump is started, expeller head 2 rotates rapidly and the centrifugal force on the liquid inside the radial tubes overcomes the air pressure in the end casing and the liquid begins accumulating in the casing. As the pressure in the casing increases, valve 105, which is pressure operated, opens and liquid flow outwardly of casing 11 through exit 110.5. Valve 105 controls the flow through drain pipe 110.5; and handle 107 for operating the valve, includes spring 108 which serves to bias blocking rod 109 into a position that prevents the flow of liquid through the threaded rod. As pressure builds in the casing, rod 109 is moved against the action spring 108 to effect the flow of liquid from the casing. Handle 107 is threaded into the valve for the purpose of adjusting the spring load on rod 109. In this embodiment, movable stoppers may be used to ensure the retention of liquid inside expeller 2. Aerodynamically shaped radial tubes also may be used so as to reduce air friction and and drag.

The advantages and improved results furnished by the method and apparatus of the present invention are apparent form the foregoing description of the preferred embodiment of the invention. Various changes and modifications may be made without departing from the spirit and scope of the invention as described in the appended claims.

I claim:

1. A centrifugal suction pump comprising:

a) a vertically disposed support tube having an upper and lower ends;

b) a liquid check valve on the lower end of said support tube adapted to be immersed in a liquid to be pumped;

c) a hollow hub rotatable mounted on the upper end of said support tube, said hub carrying a member adapted to be driven for rotating said hub on said support tube, and a plurality of horizontally disposed expeller tubes having inner and outer ends, the inner end of each expeller tube being connected to the hub such that the expeller tubes extend radially from the hub;

d) a stopper associated with each expeller tube and movably mounted on the outer end of the associated expeller tube between an operative position that seals the tube and an inoperative position that unseals the tube in response to angular rotation of the hub;

e) a primer conduit connected to said support tube for filling the later and said expeller tubes with liquid when the expeller tubes are sealed by the stoppers;

f) a check valve associated with said hub for venting the hub to ambient atmosphere thereby effecting priming of the pump;

g) wherein said expeller tubes have an aerodynamic shape for reducing drag during rotation of said hub; and h) wherein said aerodynamic shape includes means for creating an axial thrust on said hub in the direction away from the bottom of the casing.

2. A centrifugal suction pump for pumping the liquid comprising:

a) a vertically disposed support tube having an upper and lower ends;

b) a liquid check valve on the lower end of said support tube adapted to be immersed in a liquid to be pumped;

c) a hollow hub rotatable mounted on the upper end of said support tube, said hub carrying a member adapted to be driven for rotating said hub on said support tube, and a plurality of horizontally disposed expeller tubes having inner and outer ends, the inner end of each expeller tube being connected to the hub such that the expeller tubes extend radially from the hub;

d) a check valve associated with said hub for venting the hub to ambient atmosphere;

e) a stopper associated with each expeller tube, and means mounting the stopper on the outer end of the associated expeller tube so that each stopper is responsive to changes in angular rotation of the hub for sealing the expeller tube with which the stopper is associated when rotation of the hub decelerates, and for unsealing the expeller tube with which the stopper is associated when rotation of the hub is accelerates;

f) a primer conduit connected to said support tube for filling the latter and said expeller tubes with liquid when the expeller tubes are sealed by the stoppers.

g) a cover sealing said casing; and h) means for pressurizing the interior of said casing with air.

3. A centrifugal suction pump including:

a) a vertically disposed support tube having an upper and lower ends;

b) a liquid check valve on the lower end of said support tube adapted to be immersed in a liquid to be pumped;

c) a hollow hub rotatable mounted on the upper end of said support tube, said hub carrying a member adapted to be driven for rotating said hub on said support tube, and a plurality of horizontally disposed expeller tubes having inner and outer ends, the inner end of each expeller tube being connected to the hub such that the expeller tubes extend radially from the hub;

d) a stopper associated with each expeller tube and movably mounted on the outer end of the associated expeller tube between an operative position that seals the tube and an inoperative position that unseals the tube in response to angular rotation of the hub;

e) a primer conduit connected to said support tube for filling the latter and said expeller tubes with liquid when the expeller tubes are sealed by the stoppers;

f) a check valve associated with said hub for venting the hub to ambient atmosphere thereby effecting priming of the pump;

g) a circular casing having side walls that terminate in a free edge, and a bottom through said support tube passes;

h) a liquid-proof sleeve attached to the bottom wall concentric with the casing and surrounding said support, and having a top edge spaced from the free edge of said casing such that the plane of rotation of said impeller tubes is intermediate top edges of the sleeve and the casing;

i) a motor on said sleeve and having an output shaft; and j) a coupling for coupling rotation of the output shaft of the motor to the hub.

4. A centrifugal suction pump according to claim 3 including a float valve mechanism in said casing for sensing the level of liquid therein and for controlling the operation of the motor.

5. A centrifugal suction pump including:

a) a vertically disposed support tube having an upper and lower ends;

b) a liquid check valve on the lower end of said support tube adapted to be immersed in a liquid to be pumped;

c) a hollow hub rotatable mounted on the upper end of said support tube, said hub carrying a member adapted to be driven for rotating said hub on said support tube, and a plurality of horizontally disposed expeller tubes having inner and outer ends, the inner end of each expeller tube being connected to the hub such that the expeller tubes extend radially from the hub;

d) a stopper associated with each expeller tube and movably mounted on the outer end of the associated expeller tube between an operative position that seals the tube and an inoperative position that unseals the tube in response to angular rotation of the hub;

e) a primer conduit connected to said support tube for filling the latter and said expeller tubes with liquid when the expeller tubes are sealed by the stoppers; and f) a check valve associated with said hub for venting the hub to ambient atmosphere thereby effecting priming of the pump;

g) a circular casing having side walls that terminate in a free edge, and a bottom through said support tube passes;

h) a liquid-proof sleeve attached to the bottom wall concentric with the casing and surrounding said support, and having a top edge spaced from the free edge of said casing such that the plane of rotation of said impeller tubes is intermediate top edges of the sleeve and the casing; and i) a primer tank outside said casing connected to said support tube so that liquid in the tank and in the tube seeks the same level, the elevation of said primer tank being such that the level of liquid therein is above the level of said expeller tubes when the latter are stationary.

6. A centrifugal suction pump according to claim 5 including an exit conduit in the casing for releasing liquid therefrom, and a float valve for controlling the flow through said exit conduit.

7. A centrifugal suction pump according to claim 5 including a cover sealing of casing.

8. A centrifugal suction pump for pumping a liquid comprising:

a) a vertically disposed support tube having an upper and lower ends;

b) a liquid check valve on the lower end of said support tube adapted to be immersed in a liquid to be pumped;

c) a hollow hub rotatable mounted on the upper end of said support tube, said hub carrying a member adapted to be driven for rotating said hub on said support tube, and a plurality of horizontally disposed expeller tubes having inner and outer ends, the inner end of each expeller tube being connected to the hub such that the expeller tubes extend radially from the hub;

d) a stopper associated with each expeller tube and movably mounted on the outer end of the associated expeller tube between an operative position that seals the tube and an inoperative position that unseals the tube in response to angular rotation of the hub;

e) a primer conduit connected to said support tube for filling the latter and said expeller tubes with liquid when the expeller tubes are sealed by the stoppers; and f) a check valve associated with said hub for venting the hub to ambient atmosphere thereby effecting priming of the pump.

9. A centrifugal suction pump according to claim 8 wherein said expeller tubes have an aerodynamic shape for reducing drag during rotation of said hub.

10. A centrifugal suction pump according to claim 8 including means comprising clamps and cables for supporting the expeller tubes on said hub.

11. A centrifugal suction pump according to claim 8 wherein said expeller tubes comprise a plurality of sections having ends that connectable in order to effect changes in the length of the expeller tubes.

12. A centrifugal suction pump according to claim 8 including an extension on the free end of each expeller tube, and means for adjusting the angular position of said extension with respect to the axis of the expeller tube.

13. A centrifugal suction pump according to claim 8 wherein each stopper is hinged to the expeller tube with which the stopper is associated, and a gasket is provided for each stopper for sealing the expeller tube with the stopper is associated.

14. A centrifugal suction pump according to claim 13 wherein said gasket includes magnetic material on the stopper and on the outer end of the expeller tube.

15. A centrifugal suction pump according to claim 8 including:

a) a circular casing having side walls that terminate in a free edge, and a bottom through said support tube passes;

b) a liquid-proof sleeve attached to the bottom wall concentric with the casing and surrounding said support, and having a top edge spaced from the free edge of said casing such that the plane of rotation of said impeller tubes is intermediate top edges of the sleeve and the casing.

16. A centrifugal suction pump according to claim 15 including a carriage movably mounted in said sleeve for rotation about the axis of rotation of said hub on said support tube, said carriage being rigidly connected to said hub.

17. A centrifugal suction pump according to claim 15 in combination with a boat, including a mesh attached to the free edge of said sleeve for straining the liquid pump by said pump.

18. A centrifugal suction pump according to claim 1 wherein the tubes rotate in a horizontal plane when said hub is rotated, and each stopper is mounted on the tube with which it is associated for pivotal movement about a pivot axis that is perpendicular to said plane.

19. A centrifugal suction pump according to claim 18 wherein each stopper is pivotal about its pivot axis to an inoperative position unblocking the tube with which it is associated in response to the centrifugal thrust of liquid in the tube.

20. A centrifugal suction pump according to claim 18 wherein each stopper is pivotal about its pivot axis to a closed position blocking the tube with which it is associated in response to deceleration in the rotation of the tubes.

* * * * *